US005653155A

United States Patent [19]

Hausman et al.

[11] Patent Number: 5,653,155

[45] Date of Patent: Aug. 5, 1997

[54] METHOD AND APPARATUS FOR SINGLE LEVER CONTROL OF MULTIPLE ACTUATORS

[75] Inventors: Dennis J. Hausman, Peoria; John J. Krone, Dunlap, both of Ill.

[73] Assignee: Caterpillar Inc., Peoria, Ill.

[21] Appl. No.: 593,776

[22] Filed: Jan. 29, 1996

[51] Int. Cl.[6] ..... F15B 11/00; F15B 13/00

[52] U.S. Cl. ..... 91/523; 91/508; 91/511

[58] Field of Search ..... 91/508, 519, 459, 91/521, 523, 522, 511

[56] References Cited

U.S. PATENT DOCUMENTS

| | | | |
|---|---|---|---|
| 3,286,600 | 11/1966 | Colburn | 91/523 X |
| 4,034,815 | 7/1977 | Dezelan | 172/809 |
| 4,048,799 | 9/1977 | Golan et al. | 60/413 |
| 4,054,083 | 10/1977 | Utter | 91/523 |
| 4,716,728 | 1/1988 | Kakeya | 91/523 X |
| 4,884,401 | 12/1989 | Metcalf et al. | 91/523 X |
| 5,081,839 | 1/1992 | McWilliams | 60/468 |
| 5,497,805 | 3/1996 | Sunamura et al. | 91/45 X |

*Primary Examiner*—Hoang Nguyen
*Attorney, Agent, or Firm*—J. W. Burrows

[57] ABSTRACT

A method and apparatus for providing control of multiple actuators with a single control lever is provided. The method and apparatus is adapted for use in an electro-hydraulic system having a microprocessor, multiple actuators, respective electro-hydraulic directional control valves for each actuator, and individual control levers operatively associated with the microprocessor for controlling movement of the respective electro-hydraulic directional control valves. The method and apparatus is accomplished by providing a switch on each of the control levers that is operational to condition the microprocessor to direct simultaneous signals to the respective electro-hydraulic directional control valves to control each of the multiple actuators in proportion to the degree of movement of the one actuator when the switch thereon is depressed. The method and apparatus also includes a variable gain control that is selectively operational to vary the gain or response of the respective actuators relative to the degree of movement of the respective control levers.

10 Claims, 3 Drawing Sheets

MICROPROCESSOR
F
N
S
46
48
36
32
44
40
42
38
20
18
16
26
28
30
24
F L N R
F L N R

METHOD AND APPARATUS FOR SINGLE LEVER CONTROL OF MULTIPLE ACTUATORS

DESCRIPTION

1. Technical Field

This invention relates to the control of multiple actuators and more particularly to a method and apparatus for providing a single lever control of the multiple actuators.

2. Background Art

It is well known to control multiple actuators with a single lever by connecting several actuators to the same control valve. These types of arrangements do not allow independent control of the respective actuators. Likewise, it is well known to connect more than one control valve to a single lever through a series of levers so that movement of the single lever through a particular pattern results in more than one control valve being actuated. These types of arrangements normally require many mechanical connection points which results in magnification of any loose connections and does not normally permit any significant changes in the displacement of one control valve with respect to the other control valves. In order to maintain individual control of multiple actuators it has been necessary to provide a separate control lever for each control valve. When it is desirable to simultaneously actuate two control valves to lift a single member, such as a motorgrader blade, it is necessary for the operator to use both hands to manipulate the levers. It is desirable to have a single lever control which permits the operator to control multiple actuators with only one hand which frees the other hand for other functions. It is likewise desirable to provide a control which allows the operator to vary the response of the respective actuators for a given movement of the control levers.

The subject invention is directed to overcoming one or more of the problems as set forth above.

DISCLOSURE OF THE INVENTION

In one aspect of the subject invention a method is provided for control of multiple actuators with a single control lever in an electro-hydraulic system having a microprocessor, multiple actuators, respective electro-hydraulic directional control valves for each actuator, and individual control levers operatively associated with the microprocessor for controlling movement of the respective electro-hydraulic directional control valves. The method includes the steps of sensing the position of each of the respective control levers and directing a proportional signal to the respective electro-hydraulic directional control valve in response to individual movement of the respective control levers and providing a switch on each of the respective control levers that is operative when depressed to condition the microprocessor to simultaneously direct the same signal to multiple electro-hydraulic directional control valves that is proportional to the signal received from the one control lever.

In another aspect of the subject of invention an apparatus is provided for use in an electro-hydraulic system to provide control of at least two actuators with individual control levers or with only a single control lever. The electro-hydraulic system includes a microprocessor, multiple actuators, respective electro-hydraulic directional control valves for each actuator, and individual control levers operatively associated with the microprocessor for controlling movement of the respective electro-hydraulic directional control valves. The apparatus includes an electrical switch mounted on one of the individual control levers and electrically connected to the microprocessor. The electrical switch is operative, when depressed, to send a signal to the microprocessor to instruct the microprocessor to simultaneously direct the same signal to the at least two multiple electro-hydraulic directional control valves that is proportional to the signal received from the one control lever.

The present invention provides a method and apparatus controlling multiple actuators by individual control levers or by a single control lever. This permits the operator to perform other operations, such as steering the machine or shifting of the gears in the transmission.

BEST MODE FOR CARRYING OUT THE INVENTION

Figure 1:
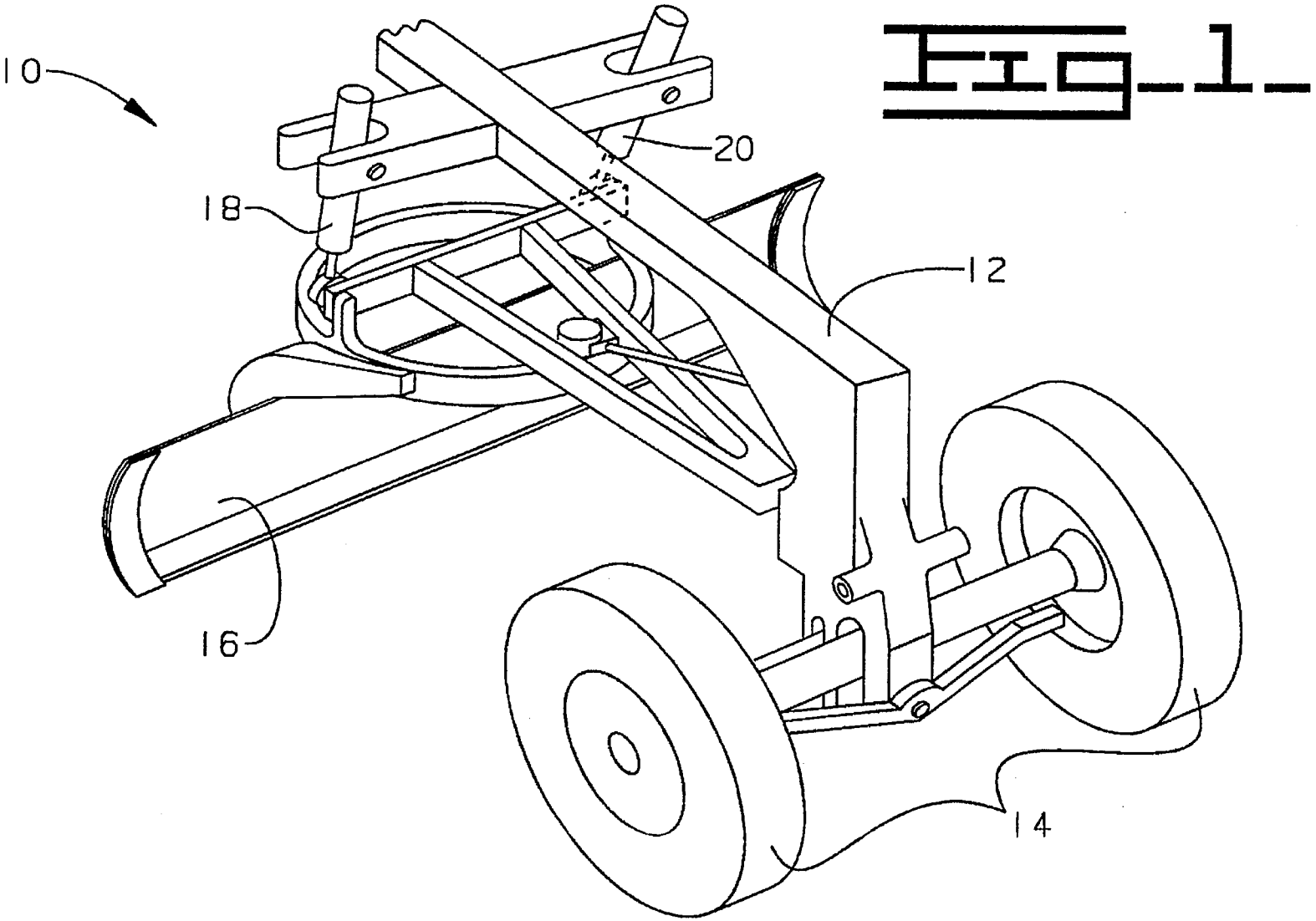
FIG. 1 is a partial diagrammatic illustration of a machine having multiple actuators connected to a single member.

Referring to FIG. 1 of the drawings, a front portion of a machine, such as a motorgrader 10, is illustrated. The front portion of the motorgrader 10 includes a frame 12, a pair of steerable front wheels 14 connected to the frame 12, a single work member, such as a blade 16, and first and second actuators 18,20 connected between the frame 12 and the blade 16. It is recognized that the use of the term multiple actuators herein means two or more even though only two are illustrated and described.

Figure 2:
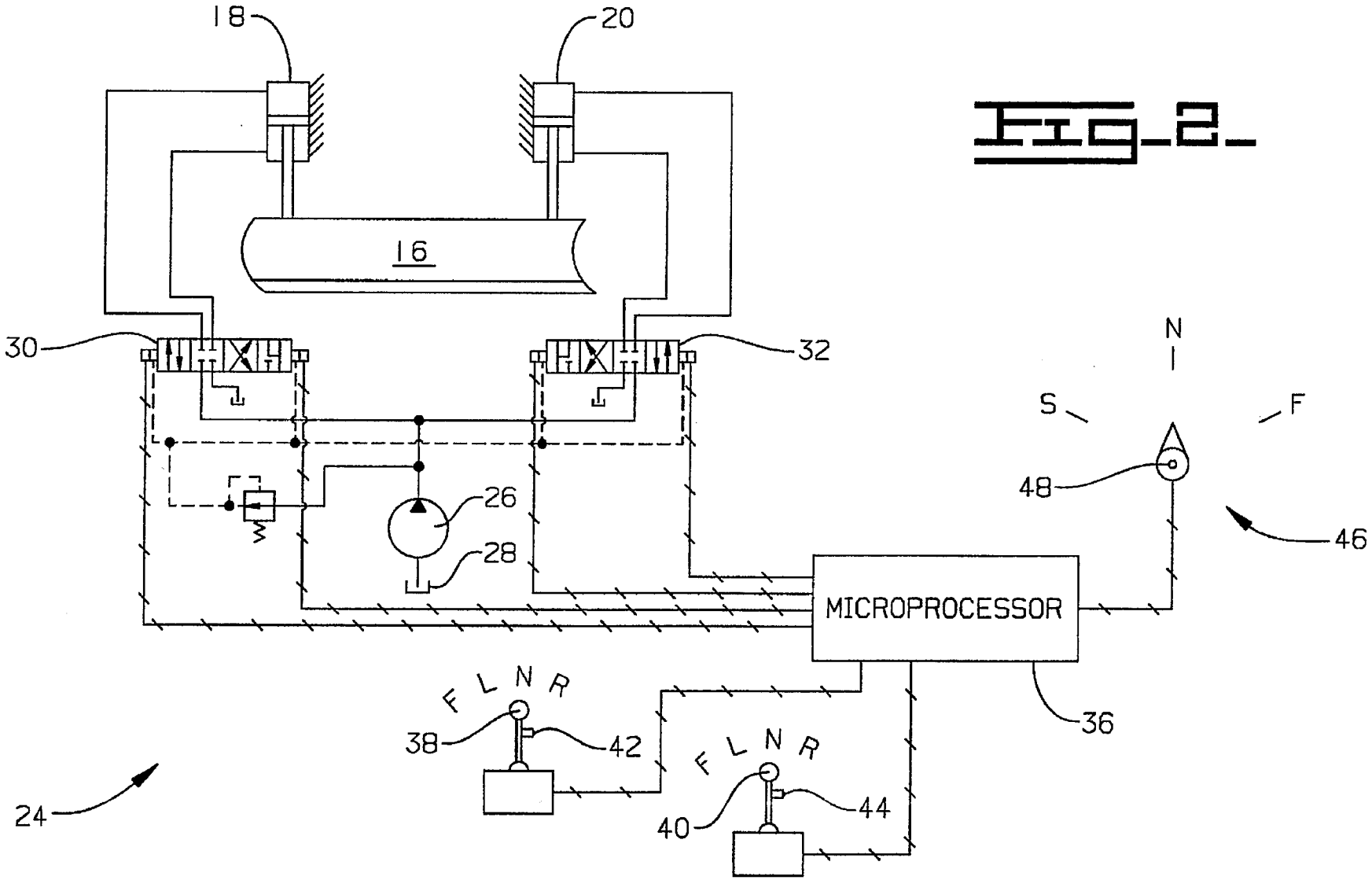
FIG. 2 is a part schematic and part diagrammatic illustration of a machine system incorporating the subject invention.

Referring to FIG. 2, an electro-hydraulic system 24 is schematically illustrated for controlling the blade 16. The electro-hydraulic system 24 includes a source of pressurized fluid, such as a pump 26, which receives fluid from a reservoir 28 and delivers the pressurized fluid to the respective first and second actuators 18,20 through respective first and second electro-hydraulic directional control valves 30,32. Each of the first and second electro-hydraulic directional control valves 30,32 is movable from a closed, neutral position toward first and second operative positions and a float position in a well known manner responsive to receipt of an electrical signal from a microprocessor 36.

The electrical signals from the microprocessor 36 are generated in response to movement of respective control levers 38,40 that are electrically connected to the microprocessor 36. The respective control levers 38,40 are moved by a machine operator between the respective neutral (N), raise (R), lower (L), and float (F) positions. The degree of movement of the respective levers 38,40 in a given direction is transmitted to the microprocessor 36 and determines the magnitude of the electrical signal being delivered from the microprocessor 36 to the respective first and second electro-hydraulic directional control valves 30,32. As noted above, the respective first and second electro-hydraulic directional control valves 30,32 are moved in proportion to the electrical signal from the microprocessor 36.

A first switch 42 is disposed on the first control lever 38 and operatively connected to the microprocessor 36 and a second switch 44 is disposed on the second control lever 40 and also operatively connected to the microprocessor 36. Depressing one of the switches 42,44 results in instructing the microprocessor 36 to simultaneously send the same electrical signal, that represents movement of the control lever 38/40 on which the one switch 42/44 is disposed, to both of the first and second electro-hydraulic directional control valves 30,32. Consequently, movement of only one control lever 38/40 results in both actuators 18,20 moving together. The same thing happens if the other of the switches 42,44 is depressed. If both switches are depressed at the same time, the control levers 38,40 operate independent of each other to individually control the respective actuators 18,20.

A variable gain control 46 is connected to the microprocessor 36 and operative to vary the response of the first and second actuators 18,20 with respect to movement of the respective control levers 38,40. In order to select the desired response mode, a mode selector 48 is movable from a normal (N) mode position to a slow (S) or fine mode position or to a fast (F) or coarse mode position. When using the slow mode, a given movement of one of the respective control levers 38,40 results in less speed of the respective actuator 18,20 then would occur with the same degree of movement of the one control lever 38,40 with the selector 48 in the normal mode position. Likewise, with the selector 48 in the fast mode position, the respective actuator 18,20 would move more than the same control lever movement with the selector 48 in the normal mode position.

Figure 3:
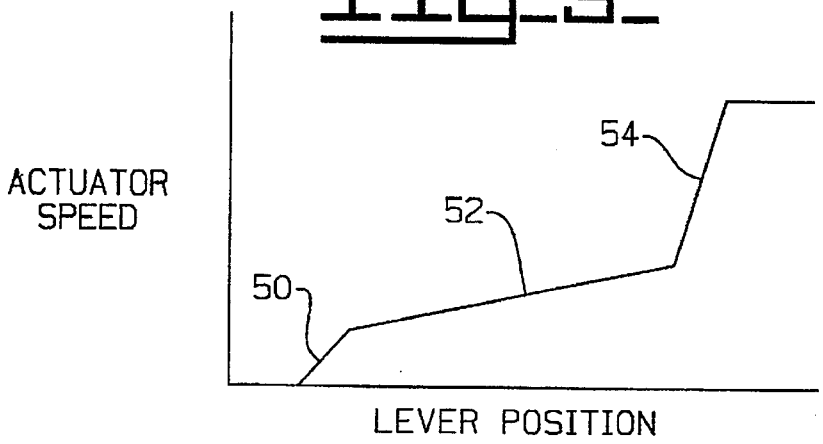
FIG. 3 is a graph representing a normal relationship between movement of a control lever and the speed of the actuator or cylinder.
Figure 4:
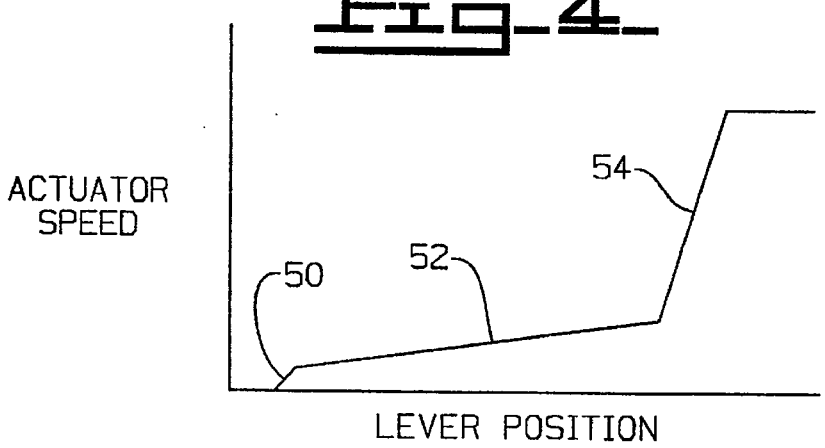
FIG. 4 is a graph representing a fine or slow relationship between movement of the control lever and the speed of the actuator.
Figure 5:
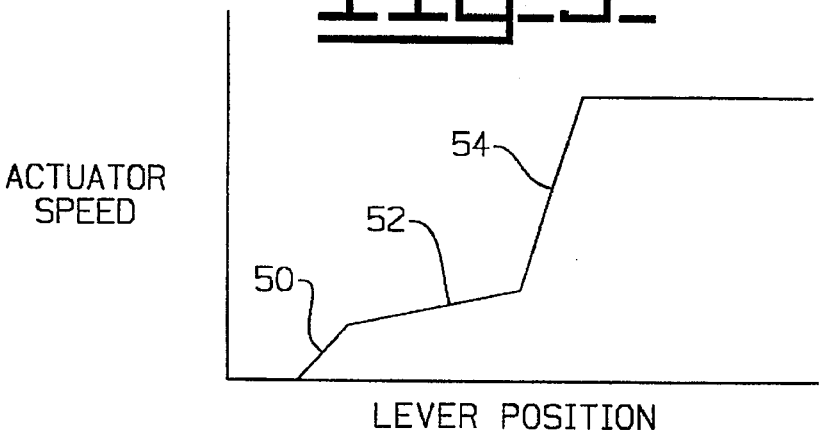
FIG. 5 is a graph representing a coarse or fast relationship between movement of the control lever and the speed of the actuator.

Referring to FIGS. 3–5, graphs are set forth to illustrate a comparison of the respective mode positions of the mode selector 48. FIG. 3 illustrates a graph depicting the speed of the actuator 18/20 with a given travel position of the associated control lever 38/40 when the selector 48 is in the normal (N) mode position. From a brief review of the graph, it is recognized that the control lever 38/40 is moved a short distance (referred to as deadband) before the actuator 18/20 moves any. The initial movement of the actuator 18/20 is controlled along a predetermined slope 50 followed by a second predetermined slope 52, referred to as the modulation phase, for a large amount of the lever travel and then along a third steeper slope 54 until the maximum speed of the actuator 18/20 is achieved.

FIG. 4 depicts a graph illustrating the speed of the actuator 18/20 relative to the control lever 38/40 position with the mode selector 48 of the variable gain control 46 in the slow (S) mode position. The various slopes of the graph of FIG. 4 uses corresponding element numbers to those of FIG. 3. Note that the movement of the actuator 18/20 has less deadband than that of FIG. 3. Additionally, the actuator 18/20 is moving at a slower speed, length of slope 50, before the modulation phase commences. The modulation phase, slope 52, is more gradual than that of the normal response illustrated in FIG. 3 and of longer duration to provide a more finite control of the actuator 18/20. The third slope 54 is basically the same as the slope 54 of FIG. 3 but it is recognized that the slope 54 could also be different if desired.

FIG. 5 depicts a graph illustrating the speed of the actuator 18/20 relative to the control lever 38/40 position with the mode selector 48 of the variable gain control 46 in the fast (F) mode position. The various slopes of the graph of FIG. 5 uses corresponding element numbers to those of FIG. 3. The deadband of this graph is quite similar to the deadband of FIG. 3 and the speed of the actuator 18/20 at the beginning of the modulation phase is also quite similar to that of FIG. 3. However, in the fast response mode, the length of the modulation phase is much shorter than that of either FIG. 3 or FIG. 4.

It is recognized that many different forms of the graphs illustrated in FIGS. 3–5 could be developed without departing from the essence of the subject invention. The subject graphs are for illustration purposes only. Likewise, the number of slopes could vary depending on the desired operating characteristics of the actuators 18,20.

INDUSTRIAL APPLICABILITY

In the operation of the machine 10 shown in FIG. 1 and the electro-hydraulic system illustrated in FIG. 2, the operator makes an input to both of the control levers 38,40 in the same direction in order to move the blade 16. If the operator moves both of the control levers 38,40 towards the "R" or raise position, electrical signals proportional to the degree of movement of the respective control levers 38,40 are directed to the microprocessor 36. The received signals from the respective control levers 38,40 are processed to identify the magnitude of the signal and direction of lever movement. Respective electrical signals proportional to the received signals are delivered to the respective electro-hydraulic directional control valves 30, 32 to proportionally move the respective directional valves 30,32 to direct pressurized fluid from the pump 26 to the rod ends of the respective actuators 18,20 to raise the blade 16. In order to lower the blade 16, the operator moves the respective control levers 38,44 towards the "L" or lower position. Electrical signals representative of the position of the respective control levers 38,40 are directed to the microprocessor 36 and the microprocessor 36 directs proportional signals to the respective electro-hydraulic directional control valves 30,32 which directs pressurized fluid to the head ends of the actuators 18,20 to lower the blade 16. As is well known, the blade 16 can be placed in a "float" by moving the respective control levers 38,40 the "F" or float position. In the float position, the head ends and the rod ends of the respective actuators 18,20 are interconnected to each other and to the reservoir 28. In this position, the blade 16 is permitted to slide along top of the work surface without having any down force being applied thereto.

From those skilled in the art, it is recognized that one side of the blade 16 can be raised higher or lower than the other side by moving over one of the control levers 38,40 or by moving one of the control levers 38,40 more or less than the movement of the other one of the control levers 38,40. Naturally this depends on the operation being performed.

As described above, raising or lowering of the blade 16 requires movement of both of the control levers 38,40 at the same time. As is well known movement of both of the control levers 38,40 at the same time requires the operator to use both hands. In the subject arrangement, movement of one the control levers 38,40 can result in both of the actuators 18,20 moving at the same time and the same rate. In order to move both actuators 18,20 at the same time, the operator merely depresses one of the switches 42,42 on one of the control levers 38,40. For example, when the operator depresses the switch 42 an electrical signal is directed to the microprocessor 36 to condition the microprocessor 36 so that on subsequent movement of the control lever 38 simultaneous signals are directed to the respective electro-hydraulic directional control valves 30,32. These simultaneous signals are proportional to the movement of the one control lever 38. Likewise, if the operator depresses the second switch 44 on the second control lever 40, simultaneous signals, that are proportional to the movement of the second control lever 40, are directed to the respective electro-hydraulic directional control valves 30,32. This allows the operator to use only one hand to raise or lower the blade 16 thus freeing the other hand for other operations such as steering the vehicle, shifting the gears of the transmission, etc.

In the event both of the switches 42,44 are depressed at the same time, the microprocessor 36 functions to send only individual signals to the respective electro-hydraulic directional control valves 30,32.

In the operation of the variable gain control 46, the operator merely switches the selector 48 from the normal (N) mode of operation to one of the slow (S) or fast (F) modes of operation. The slow mode of operation allows a more precise, slow movement of the actuators 18,20 while the fast mode of operation provide quicker movement of the actuators 18,20 for each increment of movement of the respective control levers 38,40.

The graph of FIG. 3 illustrates one example of a typical or normal mode Of operation in which the movement of the respective control levers 38,40 are plotted with respect to the resulting speed of the respective actuator 18,20. In the event the operator is inexperienced or the operator desires a more precise control of the blade, a fine mode of operation is selected by moving the selector 48 to the "S" position.

In the slow mode of operation, the movement of the respective control lever 38,40 and the resulting speed of the actuators 18,20 are depicted in the graph of FIG. 4. In the graph of FIG. 4, the deadband is less and the slope of the modulation phase is less. Consequently, for each increment of movement of the respective control levers 38,40, the respective actuators 18,20 move at a slower rate of speed. In the situation where the operator is an inexperienced operator, he has better control of the blade 16 which enables him to do a better job of blading the surface being worked. If the operator is an experienced operator, the slow mode of operation permits him to have a very precise control of the blade 16 when needing to precisely position the blade 16. The finite control of the blade 16 is provided over most of the travel distance of the respective control levers 38,40.

In the fast mode of operation, the movement of the respective control lever 38,40 and the resulting speed of the actuators 18,20 are depicted in the graph of FIG. 5, As depicted in the graph of FIG. 5, each increment of movement of the respective control lever 38,40 results in the respective actuators 18,20 moving at a faster rate of speed. Furthermore, the modulation phase is much shorter. This permits the more experienced operator to more quickly position the blade 16 to perform normal functions thus increasing productivity of the machine.

Thus the method for providing control of multiple actuators with a single control lever in an electro-hydraulic system having a microprocessor, multiple actuators, respective electro-hydraulic directional control valves for each actuator, and individual control levers operatively associated with the microprocessor for controlling movement of the respective electro-hydraulic directional control valves comprises the steps of sensing the position of each of the respective control levers and directing a proportional signal to the respective electro-hydraulic directional control valve in response to individual movement of the respective control levers, providing a switch on each of the respective control levers that is operative when depressed to condition the microprocessor to simultaneously direct the same signal to the multiple electro-hydraulic directional control valves that is proportional to the signal received from the respective one of the control lever. Additionally, the method includes the step of providing a variable gain control that is selectively operative to proportionally change the signal from the microprocessor to the respective electro-hydraulic directional valves and wherein the variable gain control provides an adjustment to vary the gain of the signal from a normal control to a slow or fine control mode to a fast or coarse control mode.

In view of the foregoing, it is readily apparent that the method and apparatus described herein provides a process and structure that permits control of multiple actuators with a single control lever while also providing independent control of each actuator. The method and apparatus also provides the ability to change the gain or response of the movement of the control levers relative to the speed of the respective actuators.

Other aspects, objects and advantages of the invention can be obtained from a study of the drawings, the disclosure and the appended claims.

We claim:

1. A method for providing control of multiple actuators with a single control lever in an electro-hydraulic system having a microprocessor, multiple actuators, respective electro-hydraulic directional control valves for each actuator, and individual control levers operatively associated with the microprocessor for controlling movement of the respective electro-hydraulic directional control valves, comprising the steps of:

sensing the position of each of the respective control levers and directing a signal proportional thereto to the respective electro-hydraulic directional control valve in response to individual movement of the respective control levers; and providing a switch on each of the respective control levers that is operative when depressed to condition the microprocessor to simultaneously direct the same signal to the multiple electro-hydraulic directional control valves that is proportional to the signal received from the one control lever.

2. The method of claim 1 wherein in the step of providing a switch on each respective control lever depressing of the switch on more than one control lever results in instructing the microprocessor to send the signal to only the respective directional control valve that is controlled by the respective control levers.

3. The method of claim 2 further including the step of providing a variable gain control that is selectively operative to proportionally change the signal from the microprocessor to the respective electro-hydraulic directional valves.

4. The method of claim 3 wherein the step of providing a variable gain control provides an adjustment to vary the gain of the signal from a normal control to a slow or fine control to a fast or coarse control.

5. An apparatus for use in an electro-hydraulic system to provide control of at least two actuators with individual control levers or with only a single control lever, the electro-hydraulic system includes a microprocessor, multiple actuators, respective electro-hydraulic directional control valves for each actuator, and individual control levers operatively associated with the microprocessor for controlling movement of the respective electro-hydraulic directional control valves, the apparatus comprising:

an electrical switch mounted on one of the individual control levers and electrically connected to the microprocessor, the electrical switch is operative, when depressed, to send a signal to the microprocessor to condition the microprocessor to simultaneously direct the same signal to the at least two multiple electro-hydraulic directional control valves that is proportional to the signal received from the one control lever.

6. The apparatus of claim 5 wherein a second electrical switch is mounted on the other control lever of the at least two control levers and electrically connected to the microprocessor, the second electrical switch is operative, when depressed, to send a signal to the microprocessor to instruct the microprocessor to simultaneously direct the same signal to the at least two multiple electro-hydraulic directional control valves that is proportional to the signal received from the second control lever.

7. The apparatus of claim 6 wherein the electro-hydraulic system includes a single work member and first and second actuators of the multiple actuators are connected to the single work member.

8. The apparatus of claim 7 wherein depressing of both electrical switches results in the microprocessor directing only individual signals to the respective electro-hydraulic directional valves from the respective first or second control levers.

9. The apparatus of claim 8 including a variable gain control connected to the microprocessor and selectively operative to proportionally change the signal from the microprocessor to the respective electro-hydraulic directional control valves.

10. The apparatus of claim 9 wherein the variable gain control is adjustable from a normal control to a slow or fine gain to a fast or coarse control.

* * * * *